US009116478B2

(12) United States Patent
Ruiz et al.

(10) Patent No.: US 9,116,478 B2
(45) Date of Patent: Aug. 25, 2015

(54) METHOD AND APPARATUS FOR AVOIDING FUSER JAMS IN AN IMAGE PRODUCTION DEVICE

(75) Inventors: Erwin Ruiz, Rochester, NY (US); Eliud Robles Flores, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 298 days.

(21) Appl. No.: 13/451,011

(22) Filed: Apr. 19, 2012

(65) Prior Publication Data

US 2013/0279922 A1 Oct. 24, 2013

(51) Int. Cl.
*G03G 15/00* (2006.01)
*G03G 15/20* (2006.01)

(52) U.S. Cl.
CPC .. *G03G 15/2035* (2013.01); *G03G 2215/00746* (2013.01); *G03G 2215/2045* (2013.01)

(58) Field of Classification Search
CPC ..... G03G 13/20; G03G 15/20; G03G 15/55; G03G 15/5008; G03G 2215/00945; G03G 15/505; G03G 2215/00075; G03G 2215/00645; G03G 2215/00746; G03G 2215/2045; G03G 15/5004; G03G 15/2035
USPC ..... 399/21, 22, 23, 33, 67–69, 122, 384, 399/400
See application file for complete search history.

(56) References Cited

U.S. PATENT DOCUMENTS

| | | | | |
|---|---|---|---|---|
| 5,978,613 | A * | 11/1999 | Mendisch et al. | 399/18 |
| 7,283,777 | B2 * | 10/2007 | Russel et al. | 399/322 |
| 2006/0269301 | A1 * | 11/2006 | Ogasawara | 399/21 |
| 2008/0101813 | A1 * | 5/2008 | Maul et al. | 399/68 |
| 2008/0157465 | A1 * | 7/2008 | Matsumoto | 271/277 |
| 2008/0317524 | A1 * | 12/2008 | Takahashi et al. | 399/329 |
| 2009/0324305 | A1 * | 12/2009 | Udaka et al. | 399/302 |

* cited by examiner

*Primary Examiner* — Matthew G Marini
*Assistant Examiner* — Quang X Nguyen
(74) *Attorney, Agent, or Firm* — Ronald E. Prass, Jr.; Prass LLP

(57) ABSTRACT

A method and apparatus for avoiding fuser jams in an image production device may include determining an entrance velocity of media entering a fuser nip during a print job, the fuser nip being the area of a fuser formed by a fuser roll meeting a pressure roll, determining an exit velocity of media exiting the fuser nip, determining a difference between the entrance velocity and the exit velocity, determining if the difference between the entrance velocity and the exit velocity exceeds a predetermined threshold, wherein if the difference between the entrance velocity and the exit velocity exceeds a predetermined threshold, retracting the pressure roll away from the fuser roll for a predetermined time period, determining if the predetermined time period has expired, wherein if the predetermined time period has expired, reposition the pressure roll to meet the fuser roll to reform the fuser nip, and resuming printing the print job.

18 Claims, 5 Drawing Sheets

METHOD AND APPARATUS FOR AVOIDING FUSER JAMS IN AN IMAGE PRODUCTION DEVICE

BACKGROUND

Disclosed herein is a method and apparatus for avoiding fuser jams in an image production device.

In high production continuous web presses, media jams in the fuser module will generate a significant productivity reduction impact as well as a potential component damage and safety issue. During a continuous web jam, the media could end up wrapped around the fuser roll. Once the media is around the roll, the media could cause permanent damage to the roll surface as toner may stick/burn to the roll surface or the media could mechanically scratch the roll surface. Depending on the media weight and the time that it takes for the operator to remove the media from the fuser roll, the media can start burning as well.

Fuser jams on continuous media are difficult to clear. The operator has to physically cut the continuous web, pull the fuser module and proceed to clear the jam. These actions will reduce productivity and will increase media waste.

SUMMARY

A method and apparatus for avoiding fuser jams in an image production device is disclosed. The method may include determining an entrance velocity of media entering a fuser nip during a print job, the fuser nip being the area of a fuser formed by a fuser roll meeting a pressure roll, determining an exit velocity of media exiting the fuser nip, determining a difference between the entrance velocity and the exit velocity, determining if the difference between the entrance velocity and the exit velocity exceeds a predetermined threshold, wherein if the difference between the entrance velocity and the exit velocity exceeds a predetermined threshold, retracting the pressure roll away from the fuser roll for a predetermined time period, determining if the predetermined time period has expired, wherein if the predetermined time period has expired, reposition the pressure roll to meet the fuser roll to reform the fuser nip, and resuming printing the print job

DETAILED DESCRIPTION

Figure 1:
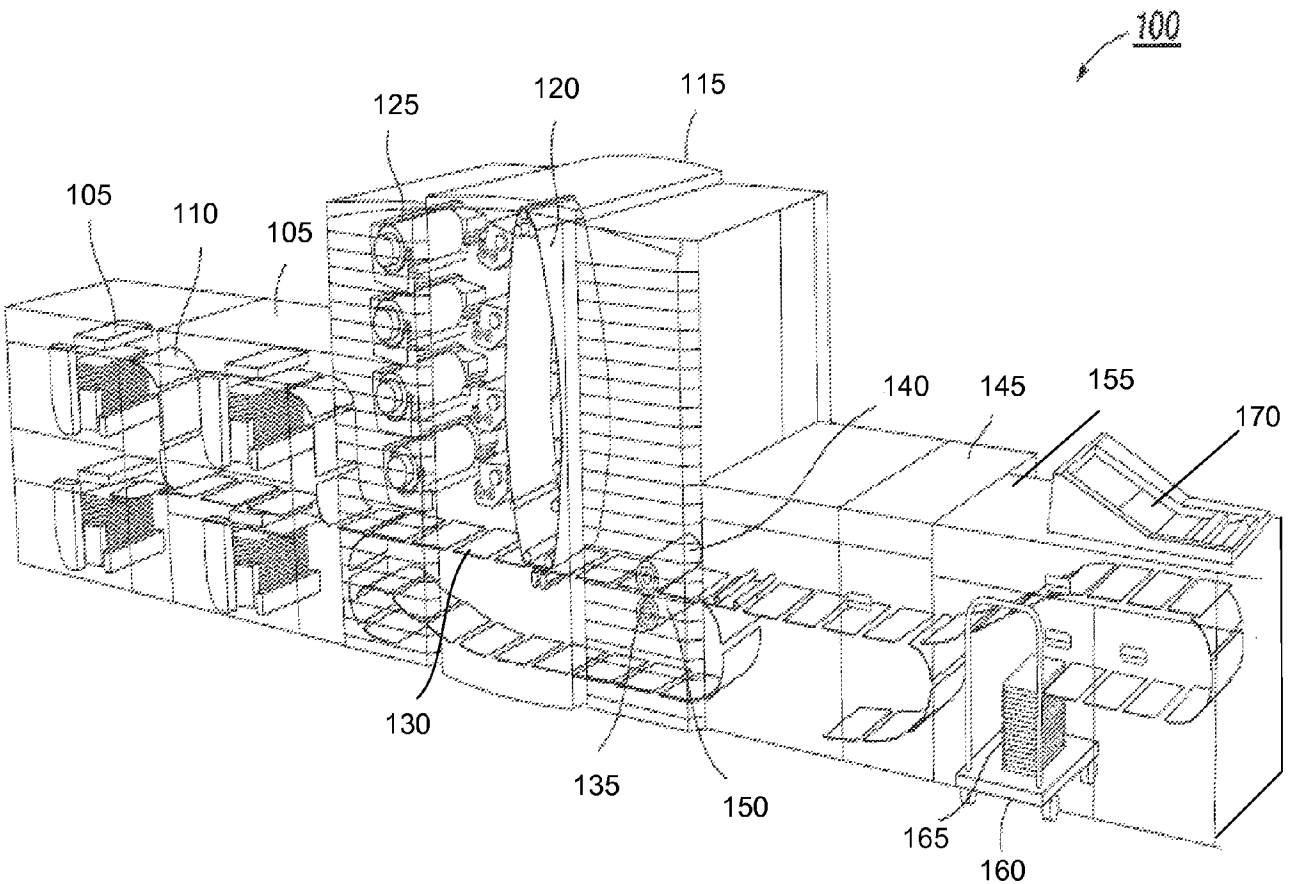
FIG. 1 is an exemplary diagram of an image production device in accordance with one possible embodiment of the disclosure.

Aspects of the embodiments disclosed herein relate to a method and apparatus for avoiding fuser jams in an image production device.

The disclosed embodiments may include a method and apparatus for avoiding fuser jams in an image production device. The method may include determining an entrance velocity of media entering a fuser nip during a print job, the fuser nip being the area of a fuser formed by a fuser roll meeting a pressure roll, determining an exit velocity of media exiting the fuser nip, determining a difference between the entrance velocity and the exit velocity, determining if the difference between the entrance velocity and the exit velocity exceeds a predetermined threshold, wherein if the difference between the entrance velocity and the exit velocity exceeds a predetermined threshold, retracting the pressure roll away from the fuser roll for a predetermined time period, determining if the predetermined time period has expired, wherein if the predetermined time period has expired, reposition the pressure roll to meet the fuser roll to reform the fuser nip, and resuming printing the print job The disclosed embodiments may further include an image production device that may include a fuser, the fuser including a fuser roll and a pressure roll, wherein a fuser nip is by the fuser roll meeting the pressure roll, a fuser nip entrance sensor that determines an entrance velocity of media entering a fuser nip during a print job, a fuser nip exit sensor that determines an exit velocity of the media exiting the fuser nip, and a fuser jam avoidance unit that determines a difference between the entrance velocity and the exit velocity, wherein if the difference between the entrance velocity and the exit velocity exceeds a predetermined threshold, the fuser jam avoidance unit retracts the pressure roll away from the fuser roll for a predetermined time period and determines if the predetermined time period has expired, wherein if the predetermined time period has expired, the fuser jam avoidance unit repositions the pressure roll to meet the fuser roll to reform the fuser nip, and signals the image production device to resume printing the print job.

The disclosed embodiments may further include computer-readable medium storing instructions for controlling a computing device for avoiding fuser jams in an image production device. The instructions may include determining an entrance velocity of media entering a fuser nip during a print job, the fuser nip being the area of a fuser formed by a fuser roll meeting a pressure roll, determining an exit velocity of media exiting the fuser nip, determining a difference between the entrance velocity and the exit velocity, determining if the difference between the entrance velocity and the exit velocity exceeds a predetermined threshold, wherein if the difference between the entrance velocity and the exit velocity exceeds a predetermined threshold, retracting the pressure roll away from the fuser roll for a predetermined time period, determining if the predetermined time period has expired, wherein if the predetermined time period has expired, reposition the pressure roll to meet the fuser roll to reform the fuser nip, and resuming printing the print job The disclosed embodiments may concern a method and apparatus that may track the media entrance and exit velocities to the fuser roll nip in order to determine and monitor if the media is slowing down due to a potential upcoming media jam. The process may calculate the difference in the entrance and exit velocity. If the difference in velocity violates a threshold condition, the process may command the pressure roll to retract (or un-cam) in order to release the media for the fuser roll nip. By releasing the media, the media (such as a continuous media web) may recover and rebalance the entrance and exit velocities, thus avoiding a potential fuser roll jam.

A fuser roll web jam can be caused by web miss-tracking, web wrinkle, drive failure or poor fuser roll stripping. Stripping performance could be degraded by excessive wear or contamination on the fuser roll. Any of these dysfunctions could affect the media entrance and exit velocities to the fuser roll nip. A change in velocity may be an indication that a potential jam is going to occur.

By monitoring the media entrance and exit velocity, the process can determine if a jam may occur. The velocities can be measured by velocity sensors, such as a wheel encoder. The following steps will explain the algorithm functionality.

Benefits of the disclosed embodiments may include:

To minimize continuous web jam at the fuser roll area.

To avoid productivity impact by minimizing clearing jams at fuser area.

To minimize mechanical damage to fuser roll surface by avoiding wrap around media on fuser roll.

To minimize toner sticking to fuser roll surface by minimizing time to clear jams on fuser area (the longer that the toner is on contact to the fuser roll surface the more potential to permanently stick to the roll).

The process can help to determine if the components are reaching end of life prior to create a hard jam.

The process can be considered green as media waste is reduced.

To avoid serious safety hazard should a jam occur, the fuser rolls don't cool down fast enough, and the media ignites.

FIG. 1 is an exemplary diagram of an image production device 100 in accordance with one possible embodiment of the disclosure. The image production device 100 may be any device that may be capable of making image production documents (e.g., printed documents, copies, etc.) through a xerographic process, including a copier, a printer, a facsimile device, and a multi-function device (MFD), for example.

The image production device 100 may include two media feeder modules 105 arranged in series, an image production module 115 adjacent the media feeding modules 105, an inverter module 145 adjacent the image production module 115, a media transport section, 130, and two finishing modules 155 arranged in series adjacent the inverter module 145. In the image production device 100, the media feeder modules 105 feed media to the image production module 115.

In the image production module 115, toner is transferred from a series of developer stations 125 to a charged photoreceptor belt 120 to form toner images on the photoreceptor belt 120 and produce toner images. The toner images are transferred to respective media 110 fed through the paper path. The media sheets (or continuous media web) may be advanced through a fuser 135 including a fuser roll 140 and pressure roll 150, which form a nip where heat and pressure are applied to the media to fuse toner images onto the media.

The inverter module 145 may manipulate media exiting the image production module 115 by either passing the media through to the finishing modules 155, or inverting and returning the media to the image production module 115. In the finishing modules 155, the printed media sheets may be loaded onto a stacker device 160, such as a stacker tray, cart, etc. to form a printed media stack 165, or onto a media stacking tray 170 located above or adjacent to the finishing module 155, for example.

The finishing module 155 may include finishing hardware for stacking, folding, stapling, binding, etc., prints which are output from the image production module 115. The image production device 100 may also include a local user interface (not shown) for controlling its operations, although another source of image data and instructions may include any number of computers to which the printer is connected via a network.

While the term printed media stack 165 is used for ease of discussion, the media stack 165 may represent any type of media sheets used to produce documents in the image production device 100, such as any type of paper, plastic, photo paper, cardboard, etc. In addition, for ease of discussion, the term media stack 170 may represent an entire media stack or a portion of a media stack, for example.

Figure 2:
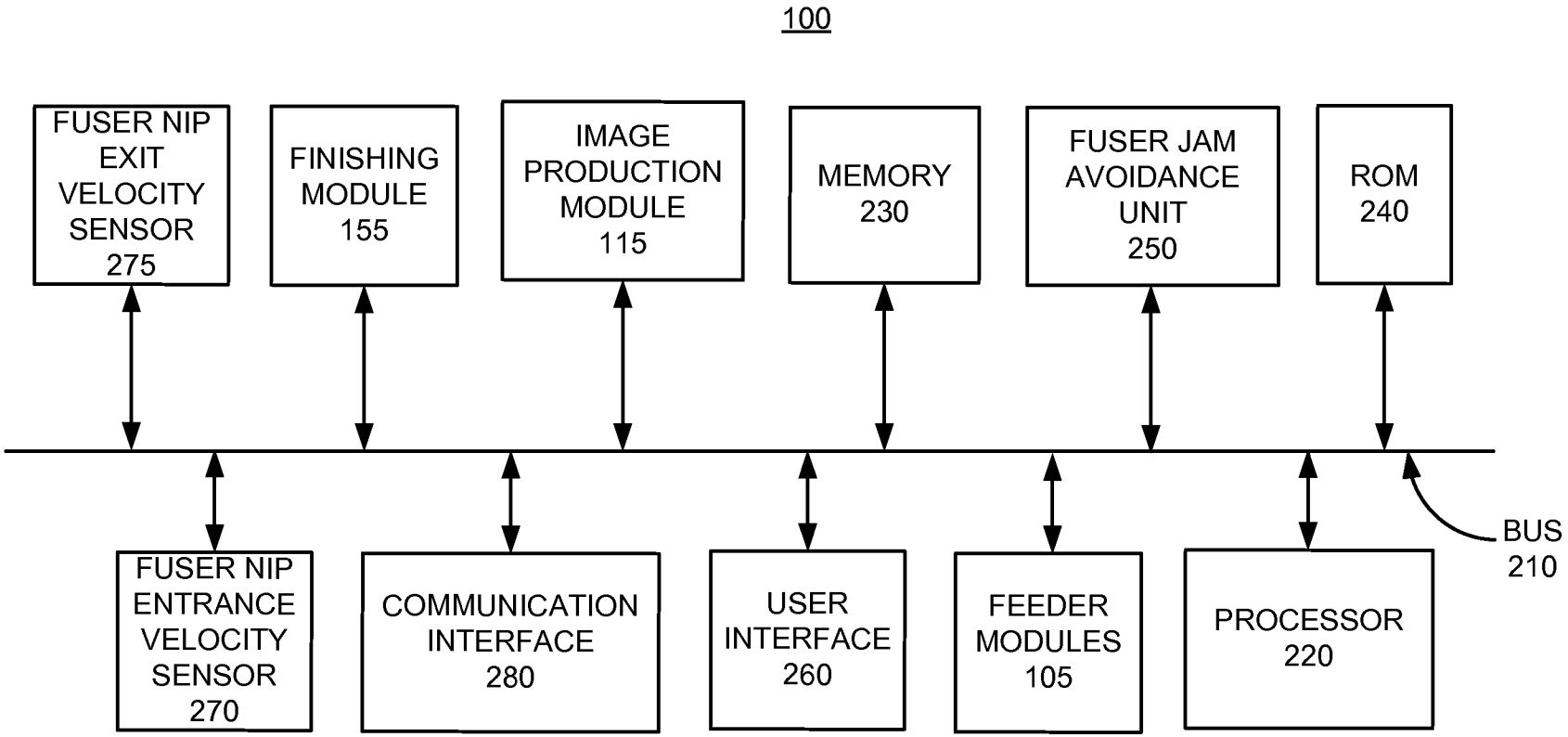
FIG. 2 is an exemplary block diagram of the image production device in accordance with one possible embodiment of the disclosure.

FIG. 2 is an exemplary block diagram of the image production device 100 in accordance with one possible embodiment of the disclosure. FIG. 2 is an exemplary block diagram of the image production device 100 in accordance with one possible embodiment of the disclosure. The image production device 100 may include a bus 210, feeder modules 105, image production section 115, finishing module 155, a processor 220, a memory 230, a read only memory (ROM) 240, a fuser jam avoidance unit 250, a user interface 260, a nip entrance velocity sensor 270, a nip exit velocity sensor 275, and a communication interface 280. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

As stated above, user interface 260 may include one or more conventional mechanisms that permit a user to input information to and interact with the image production unit 100, such as a keyboard, a display, a mouse, a pen, a voice recognition device, touchpad, buttons, etc., for example. The finishing module 155 may include one or more conventional mechanisms that output image production documents to the user, including output trays, output paths, finishing section, etc., for example. The image production module 115 may include an image printing and/or copying section, a scanner, a fuser, a spreader, etc., for example.

The nip entrance velocity sensor 270 and the nip exit velocity sensor 275 may be an encoder-type (e.g., wheel) sensor, an infra-red sensor, a contact sensor, an light emitting display (LED) sensor, or any sensor known to those of skill in the art that may be able to detect the velocity of media entering and exiting (respectively) the fuser roll nip. The fuser roll nip may be defined as the area in the fuser 135 where the fuser roll 140 meets the pressure roll 150 as media is fed through to be imaged (marked).

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

The operation of the fuser jam avoidance unit 250 will be discussed below in relation to the flowchart in FIG. 3.

Figure 3:
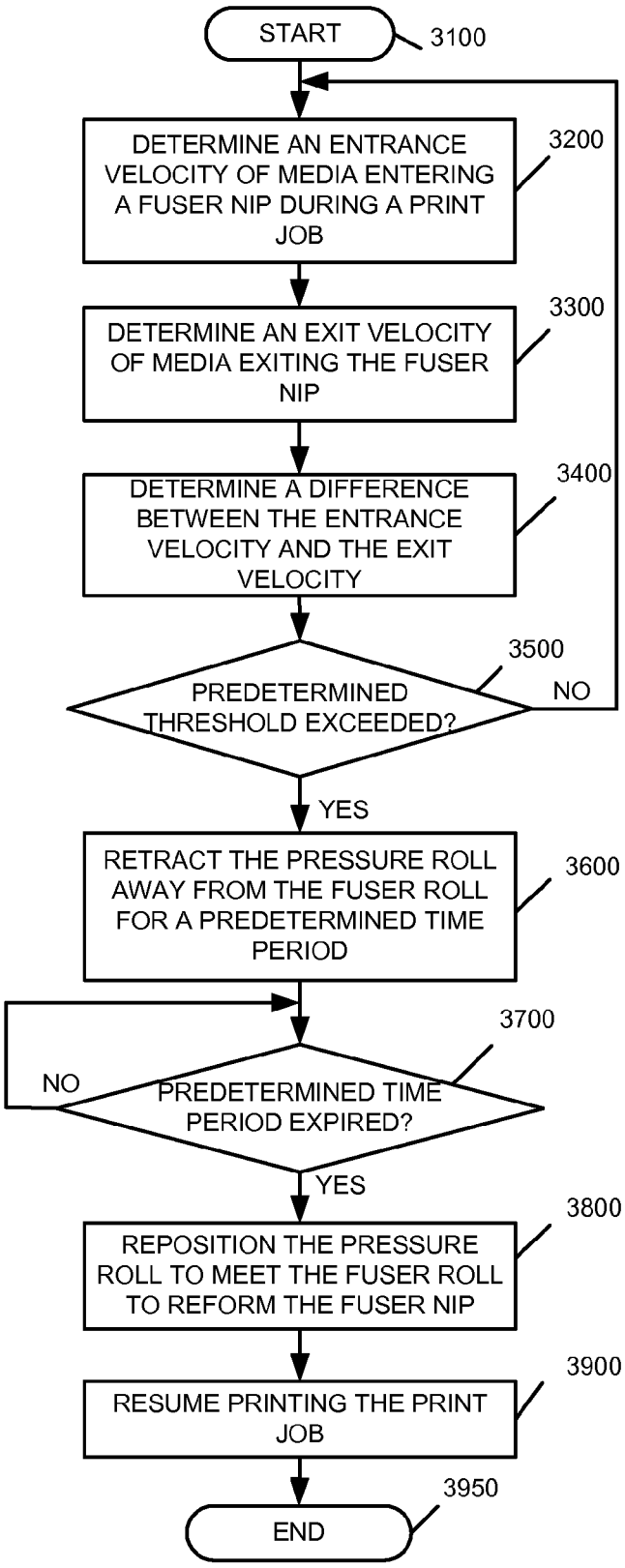
FIG. 3 is exemplary flowchart of the fuser jam avoidance process in accordance with one possible embodiment of the disclosure.

FIG. 3 is exemplary flowchart of the fuser jam avoidance process in accordance with one possible embodiment of the disclosure. The process may begin at step 3100 and may continue to step 3200 where the fuser nip entrance sensor 270 may determine the entrance velocity (V1) of media entering the fuser nip 420 during a print job. At step 3300, the fuser nip exit sensor 275 may determine the exit velocity (V2) of the media exiting the fuser nip 420. Note that the entrance and exit velocities may be measured in any standard speed measurement, such feet per second, meters per second, etc.

At step 3400, the fuser jam avoidance unit 250 may determine the difference between the entrance velocity and the exit velocity. At step 3500, the fuser jam avoidance unit 250 may determine if the difference between the entrance velocity and the exit velocity exceeds a predetermined threshold. The predetermined threshold may vary depending on a media type (e.g., thickness (paper, cardstock, etc.), size, (letter, A4, legal, etc.), continuous web, or other type) required for the print job, for example. The predetermined threshold may be measured in any standard velocity measurement, such feet per second, meters per second, etc. If the difference between the entrance velocity and the exit velocity does not exceed the predetermined threshold, the process returns to step 3200.

Figure 4:
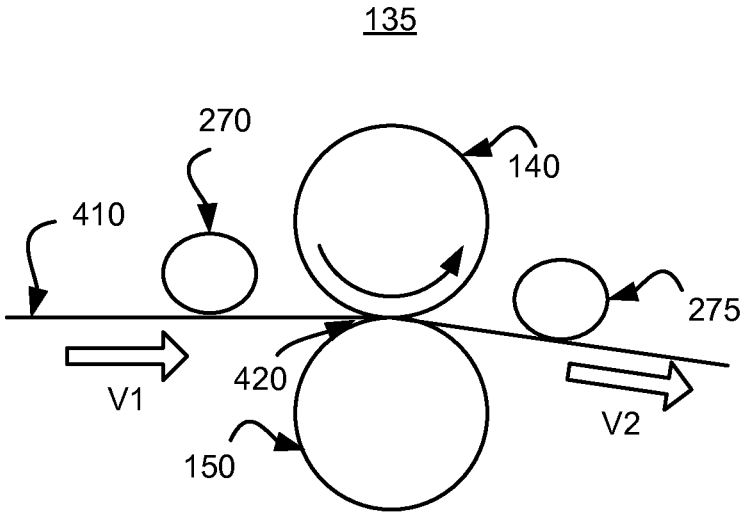
FIG. 4 is an exemplary diagram of the fuser environment in accordance with one possible embodiment of the disclosure.

FIG. 4 is an exemplary diagram of the fuser 135 in accordance with one possible embodiment of the disclosure. The fuser 135 is shown in operation where the entrance velocity (V1) is greater than the exit velocity (V2) and the difference between V1 and V2 does not exceed a predetermined threshold.

If at step 3500, the difference between the entrance velocity and the exit velocity exceeds the predetermined threshold, the process may go to step 3600 where the fuser jam avoidance unit 250 may retract the pressure roll 150 away from the fuser roll 140 for a predetermined time period. The print job may be paused for at least the predetermined time period or may continue to be processed. The predetermined time period may be a fraction of a second (0.05-0.9 seconds, or seconds, 1-3 seconds, for example).

Figure 5:
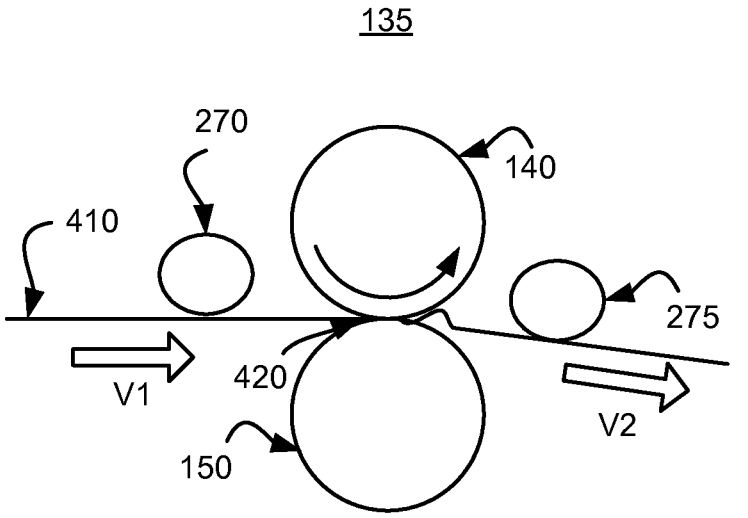
FIG. 5 is an exemplary diagram of the fuser environment where a fuser jam has been detected in accordance with one possible embodiment of the disclosure.
Figure 6:
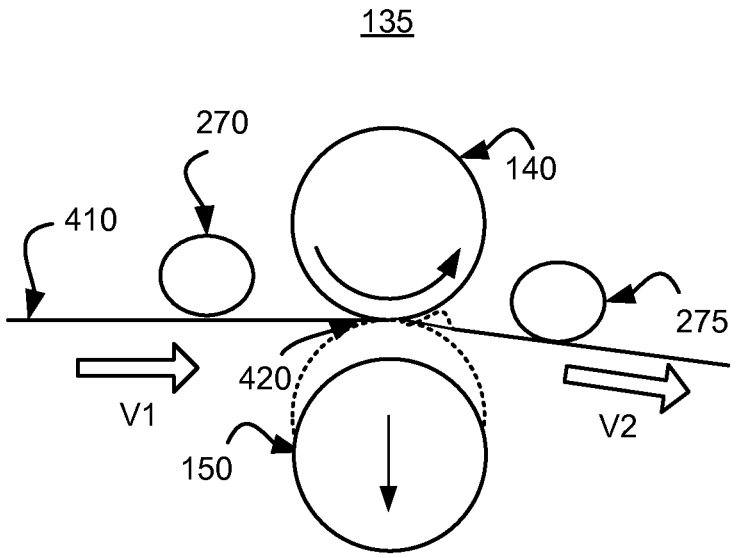
FIG. 6 is an exemplary diagram of the fuser environment where the pressure roll is moved to avoid a fuser jam in accordance with one possible embodiment of the disclosure.

FIG. 5 is an exemplary diagram of the fuser 135 where a fuser jam has been detected in accordance with one possible embodiment of the disclosure. Upon the detection of the difference in the entrance velocity (V1) and exit velocities (V1) exceeding the predetermined threshold, in FIG. 6, the pressure roll 140 is shown to be moved away from the fuser roll 150 to avoid a fuser jam in accordance with one possible embodiment of the disclosure. As shown, the pressure roll 150 retracts away from the fuser roll 140 for a predetermined time period. The pressure roll 150 retraction may be a linear (or 180 degree) retraction or at an angle as long as the retraction is away from the fuser roll 140.

Figure 7:
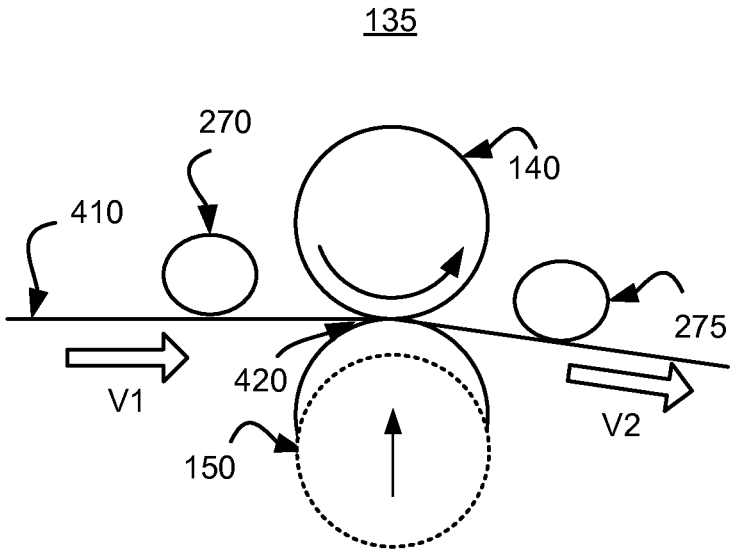
FIG. 7 is an exemplary diagram of the fuser environment where the pressure roll is returned to operating position in accordance with one possible embodiment of the disclosure.

At step 3700, the fuser jam avoidance unit 250 may determine if the predetermined time period has expired. If the predetermined time period has not expired, the process returns to step 3700. If at step 3700, the predetermined time period has expired, the process may go to step 3800 where the fuser jam avoidance unit 250 may reposition the pressure roll 150 to meet the fuser roll 140 to reform the fuser nip 420. This process is shown in FIG. 7 where the pressure roll 150 is returned to operating position against the fuser roll 140 and the fuser nip 420 is reformed in accordance with one possible embodiment of the disclosure. At step 3900, the fuser jam avoidance unit 250 may signal the image production device 100 to resume printing the print job. The process may then go to step 3950 and end.

Note that based on the difference between the entrance velocity (V1) and the exit velocity (V2), or the frequency of pressure roll 150 retractions, the end-of-life of the fuser roll 140 and/or the pressure roll 150 may be determined. In this manner, a replace threshold in the difference in entrance velocity and exit velocity may be used whereby if the threshold exceeds a particular amount or a number of occurrences, the fuser jam avoidance unit 250 may notify the user that either or any of the fuser 135, the fuser roll 140, or the pressure roll 150 are in need of service or replacement. Alternatively (or in addition), a counter for the number of pressure roll 150 retractions may be used such that if the number of retractions exceed a predetermined number, the fuser jam avoidance unit 250 may notify the user that either or any of the fuser 135, the fuser roll 140, or the pressure roll 150 are in need of service or replacement.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for avoiding fuser jams in an image production device, comprising:

determining an entrance velocity of media entering a fuser nip during a print job by monitoring media velocity at the fuser nip entrance using a sensor disposed at the fuser nip entrance, the fuser nip being the area of a fuser formed by a fuser roll meeting a pressure roll;

determining an exit velocity of media exiting the fuser nip;

determining a difference between the entrance velocity and the exit velocity;

determining if the difference between the entrance velocity and the exit velocity exceeds a predetermined threshold, wherein when the difference between the entrance velocity and the exit velocity exceeds a predetermined threshold, retracting the pressure roll away from the fuser roll for a predetermined time period, wherein the predetermined threshold varies depending on a media type required for the print job;

determining if the predetermined time period has expired, wherein when the predetermined time period has expired, reposition the pressure roll to meet the fuser roll to reform the fuser nip;

and resuming printing the print job.

2. The method of claim 1, wherein based on the difference between the entrance velocity and the exit velocity, determining an end-of-life for at least one of the fuser roll and the pressure roll.

3. The method of claim 1, wherein based on the frequency of pressure roll retractions, determining an end-of-life for at least one of the fuser roll and the pressure roll.

4. The method of claim 1, wherein the media is a continuous web media.

5. The method of claim 1, wherein the print job is paused for at least the predetermined time period.

6. The method of claim 1, wherein the image production device is one of a copier, a printer, a facsimile device, and a multi-function device.

7. An image production device, comprising:

a fuser, the fuser including a fuser roll and a pressure roll, wherein a fuser nip is by the fuser roll meeting the pressure roll;

a fuser nip entrance sensor that determines an entrance velocity of media entering a fuser nip during a print job, the fuser nip sensor being configured to sense media entering the fuser nip;

a fuser nip exit sensor that determines an exit velocity of the media exiting the fuser nip; and a fuser jam avoidance unit that determines a difference between the entrance velocity and the exit velocity, wherein when the difference between the entrance velocity and the exit velocity exceeds a predetermined threshold, the fuser jam avoidance unit retracts the pressure roll away from the fuser roll for a predetermined time period and determines if the predetermined time period has expired, wherein when the predetermined time period has expired, the fuser jam avoidance unit repositions the pressure roll to meet the fuser roll to reform the fuser nip, and signals the image production device to resume printing the print job, wherein the predetermined threshold varies depending on a media type required for the print job.

8. The image production device of claim 7, wherein based on the difference between the entrance velocity and the exit velocity, the fuser jam avoidance unit determines an end-of-life for at least one of the fuser roll and the pressure roll.

9. The image production device of claim 7, wherein based on the frequency of pressure roll retractions, the fuser jam avoidance unit determines an end-of-life for at least one of the fuser roll and the pressure roll.

10. The image production device of claim 7, wherein the media is a continuous web media.

11. The image production device of claim 7, wherein the fuser jam avoidance unit signals the image production device to pause the print job for at least the predetermined time period.

12. The image production device of claim 7, wherein the image production device is one of a copier, a printer, a facsimile device, and a multi-function device.

13. A non-transitory computer-readable medium storing instructions for controlling a computing device for avoiding fuser jams in an image production device, the instructions comprising:

determining an entrance velocity of media entering a fuser nip during a print job using a first sensor, the fuser nip being the area of a fuser formed by a fuser roll meeting a pressure roll;

determining an exit velocity of media exiting the fuser nip using a second sensor;

determining a difference between the entrance velocity and the exit velocity the fuser nip;

determining if the difference between the entrance velocity and the exit velocity exceeds a predetermined threshold, wherein when the difference between the entrance velocity and the exit velocity exceeds a predetermined threshold, retracting the pressure roll away from the fuser roll for a predetermined time period, wherein the predetermined threshold varies depending on a media type required for the print job;

determining if the predetermined time period has expired, wherein when the predetermined time period has expired, reposition the pressure roll to meet the fuser roll to reform the fuser nip;

and resuming printing the print job.

14. The non-transitory computer-readable medium of claim 13, wherein based on the difference between the entrance velocity and the exit velocity, determining an end-of-life for at least one of the fuser roll and the pressure roll.

15. The non-transitory computer-readable medium of claim 13, wherein based on the frequency of pressure roll retractions, determining an end-of-life for at least one of the fuser roll and the pressure roll.

16. The non-transitory computer-readable medium of claim 13, wherein the media is a continuous web media.

17. The non-transitory computer-readable medium of claim 13, wherein the print job is paused for at least the predetermined time period.

18. The non-transitory computer-readable medium of claim 13, wherein the image production device is one of a copier, a printer, a facsimile device, and a multi-function device.

* * * * *